US007188821B2

(12) United States Patent
Curtis

(10) Patent No.: US 7,188,821 B2
(45) Date of Patent: Mar. 13, 2007

(54) MAGNETIC ASSEMBLY FOR REVERSIBLY SECURING A POST

(75) Inventor: Mark A. Curtis, Vancouver, WA (US)

(73) Assignee: Pacific Cascade Parking Equipment Corporation, Vancouver, WA (US)

( * ) Notice: Subject to any disclaimer, the term of this patent is extended or adjusted under 35 U.S.C. 154(b) by 0 days.

(21) Appl. No.: 10/852,438

(22) Filed: May 24, 2004

(65) Prior Publication Data

US 2004/0222338 A1 Nov. 11, 2004

Related U.S. Application Data

(62) Division of application No. 10/270,790, filed on Oct. 11, 2002, now Pat. No. 6,739,567.

(51) Int. Cl.
*A47G 29/00* (2006.01)
*F16M 11/00* (2006.01)

(52) U.S. Cl. ..... 248/683; 248/206.5; 248/519; 248/529

(58) Field of Classification Search ..... 248/248, 248/206.5, 519, 529, 683, 909; 52/DIG. 4; 40/606.01, 607.01
See application file for complete search history.

(56) References Cited

U.S. PATENT DOCUMENTS 1,342,001 A 6/1920 Schulte
2,887,988 A 5/1959 Cottongim
2,995,983 A * 8/1961 Davis ..... 248/480
3,220,132 A * 11/1965 Swiger et al. ..... 40/711
3,349,531 A 10/1967 Watson
3,521,413 A 7/1970 Scott
3,552,073 A 1/1971 Millerbernd
3,563,502 A 2/1971 Dayson
3,572,223 A 3/1971 Vierregger
3,586,145 A 6/1971 Cunningham et al.

(Continued)

FOREIGN PATENT DOCUMENTS

DE 200 14 185 U1 10/2000

(Continued)

OTHER PUBLICATIONS

"Standard Magnet Assemblies," MMC Magnetics Corporation, Sep. 30, 2002, one page, © 2001.

*Primary Examiner*—Amy J. Sterling
(74) *Attorney, Agent, or Firm*—Christensen O'Connor Johnson Kindness PLLC

(57) ABSTRACT

Described is a removable assembly for use on a fixed surface. The assembly includes a post having a base (42) and an attachment assembly (8). The attachment assembly includes a base plate (10) and a magnet assembly (12), both capable of carrying a magnetic current. The magnet assembly includes a housing (20) and a magnet (22) disposed within the housing. To use, the magnet assembly is placed adjacent the base plate, the magnetic forces attracting and holding them together. The magnet is positioned apart from the base plate while the housing contacts the base plate to form the magnet circuit. An attachment plate (30) is connected to the housing upper wall adjacent its outer surface. The attachment plate includes one or more outwardly projecting attachment bolts (26). As assembled, the bolts engage corresponding openings (48) in the post base (42).

20 Claims, 4 Drawing Sheets

U.S. PATENT DOCUMENTS 3,625,406 A 12/1971 Campbell
3,705,962 A 12/1972 Banister
3,750,865 A 8/1973 Harrell
3,837,752 A 9/1974 Shewchuk
3,967,905 A 7/1976 Hsieh
4,048,776 A 9/1977 Sato
4,059,934 A 11/1977 Hayamizu
4,079,559 A 3/1978 Tenbrummeler
4,154,037 A 5/1979 Anderson
4,303,054 A 12/1981 Lore
4,337,039 A 6/1982 Martin
4,369,697 A 1/1983 Millington
4,377,268 A 3/1983 Wolford
4,517,043 A 5/1985 Martin et al.
4,584,855 A 4/1986 Burlingame
4,586,616 A * 5/1986 Cooper et al. ..... 211/88.04
4,619,456 A 10/1986 Meggs
4,850,564 A 7/1989 Padin
4,919,386 A 4/1990 Cassina
H865 H * 1/1991 Sery et al. ..... 102/306
5,039,100 A 8/1991 Cortese
5,088,683 A 2/1992 Briden
5,160,111 A 11/1992 Hugron
5,178,356 A 1/1993 Schouwey
5,187,889 A 2/1993 Kraselsky et al.
5,282,963 A 2/1994 Hull et al.
5,306,467 A * 4/1994 Douglas-Hamilton et al. ..... 422/99
5,375,433 A 12/1994 Skalet
5,481,835 A 1/1996 Bloom
5,558,455 A 9/1996 Emery
5,597,275 A 1/1997 Hogan
5,609,317 A * 3/1997 Glynn et al. ..... 248/206.5
5,662,300 A 9/1997 Michelson
5,816,554 A 10/1998 McCracken
5,855,443 A 1/1999 Faller et al.
5,901,525 A 5/1999 Doeringer et al.
5,992,804 A 11/1999 Johnson
6,035,576 A 3/2000 Bozeman
6,042,080 A 3/2000 Shepherd et al.
6,042,461 A 3/2000 Pearson
6,095,017 A 8/2000 Long
6,098,361 A 8/2000 Roten et al.
6,141,928 A 11/2000 Platt
6,199,814 B1 3/2001 Lee
6,240,689 B1 6/2001 Haddad et al.
6,250,835 B1 6/2001 Chamel
6,289,636 B1 9/2001 White et al.
6,305,656 B1 10/2001 Wemyss
6,324,800 B1 12/2001 Valentz et al.
D457,661 S 5/2002 Goodall
6,390,436 B2 5/2002 Barnes et al.
6,394,519 B1 * 5/2002 Byers et al. ..... 294/64.1
6,422,783 B1 7/2002 Jordan
6,427,965 B1 8/2002 McCracken
6,457,895 B1 10/2002 Salman
6,477,749 B1 11/2002 Reiter
6,489,947 B2 12/2002 Hesley et al.
6,540,196 B1 4/2003 Ellsworth
6,681,519 B2 1/2004 Cone
6,712,330 B1 3/2004 Damiano
6,792,708 B2 9/2004 Dicke et al.
2002/0145090 A1 * 10/2002 Schenk, Jr. ..... 248/206.5
2003/0098701 A1 5/2003 Tatematsu et al.
2004/0089771 A1 5/2004 Pap

FOREIGN PATENT DOCUMENTS

GB 1172460 A 12/1969
GB 2199355 A 7/1988

* cited by examiner

MAGNETIC ASSEMBLY FOR REVERSIBLY SECURING A POST

CROSS-REFERENCE TO RELATED APPLICATION

This application is a division of application Ser. No. 10/270,790, filed Oct. 11, 2002 now U.S. Pat. No. 6,739, 567.

FIELD OF THE INVENTION

The present invention relates to supports, and more particularly, to a frangible magnetic assembly for use in attaching a post, stanchion, pole, standard, divider, delineator, or the like, to a fixed base.

BACKGROUND OF THE INVENTION

Cities often have a need for a temporary sign that can be used to alert drivers as to when it is unacceptable to park their vehicles at a particular location, e.g., due to a parade, construction work, vehicle loading/unloading, etc. In the past, traditional parking meters were available on which workers could place "No Parking" hoods or covers. These meters are being eliminated in many cities in favor of single, centrally located parking pay stations.

Thus, a need exists for a temporary structure to support a sign or other indicator at a particular height and location. To meet this need, a preferred arrangement would be capable of attaching a post, stanchion, pole, standard, or the like, to a fixed base. Ideally, the structure would be easy to install and remove by authorized personnel, but difficult to disturb by unauthorized persons. In addition, it would be advantageous for some applications, if the device could preferably withstand the impact of being inadvertently hit by a vehicle. The present invention is directed to fulfilling these needs and others as described below.

SUMMARY OF THE INVENTION

In accordance with aspects of the present invention, a removable assembly for use on a fixed surface is described. The assembly includes a post with a base and an attachment assembly. In one embodiment, the post is a self-righting impact-recovery post. An optional shroud is available for placement between the attachment plate and the base of the post.

The attachment assembly includes a base plate capable of carrying a magnetic current and capable of engaging the fixed surface. The a magnet assembly includes a housing and a magnet disposed within the housing. The housing is formed of a magnetizable material and includes an upper wall with an outer surface. As formed, magnetic current from the magnet causes an attractive force between the housing and the base plate, the magnet itself being positioned apart from the base plate while the housing contacts the base plate. An attachment plate is attached to the housing upper wall, adjacent its outer surface. The attachment plate includes one or more outwardly projecting attachment bolts. These bolts engage the base of the post, as assembled.

In accordance with other aspects of this invention, in another embodiment, the magnet is a ring magnet and the housing has a circular cup shape. Alternatively, an arrangement is described in which the magnet is a bar magnet and the housing has a rectangular channel shape. As assembled, the bar magnet is located colinearly in the housing. Further configurations may be formed in which multiple bar magnets and channel housings are used, each having a unique orientation.

In accordance with further aspects of this invention, the base plate includes an opening and the attachment plate includes a bolt extending downward from the attachment plate, through the magnet assembly, and engaging the opening of the base plate. During use, this engagement helps to maintain the attachment plate and magnet assembly on the base plate.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
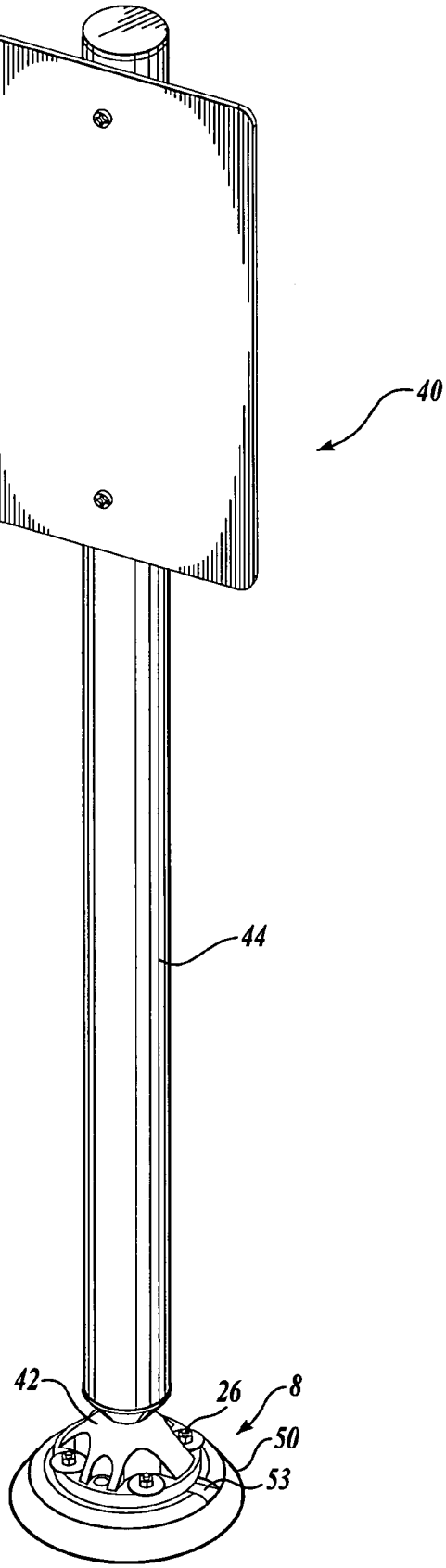
FIG. 1 is a perspective view of a separable magnetic attachment assembly formed in accordance with the present invention.

Referring to FIG. 1, the present invention is an attachment assembly 8 particularly useful for securing a post, stanchion, pole, standard, or the like, to a fixed base. As used herein, the term "post" is used generally to mean any type of temporary object, and particularly elongated objects. Examples include posts that hold signs, posts used in sports applications, and posts used in creating temporary fences or barriers. Numerous other applications are possible. As delineated by the claims, the assembly may also be used with other objects (elongated or otherwise) for which it is desirable to have a quick and easy means of separably attaching the object to a base.

Figure 2A:
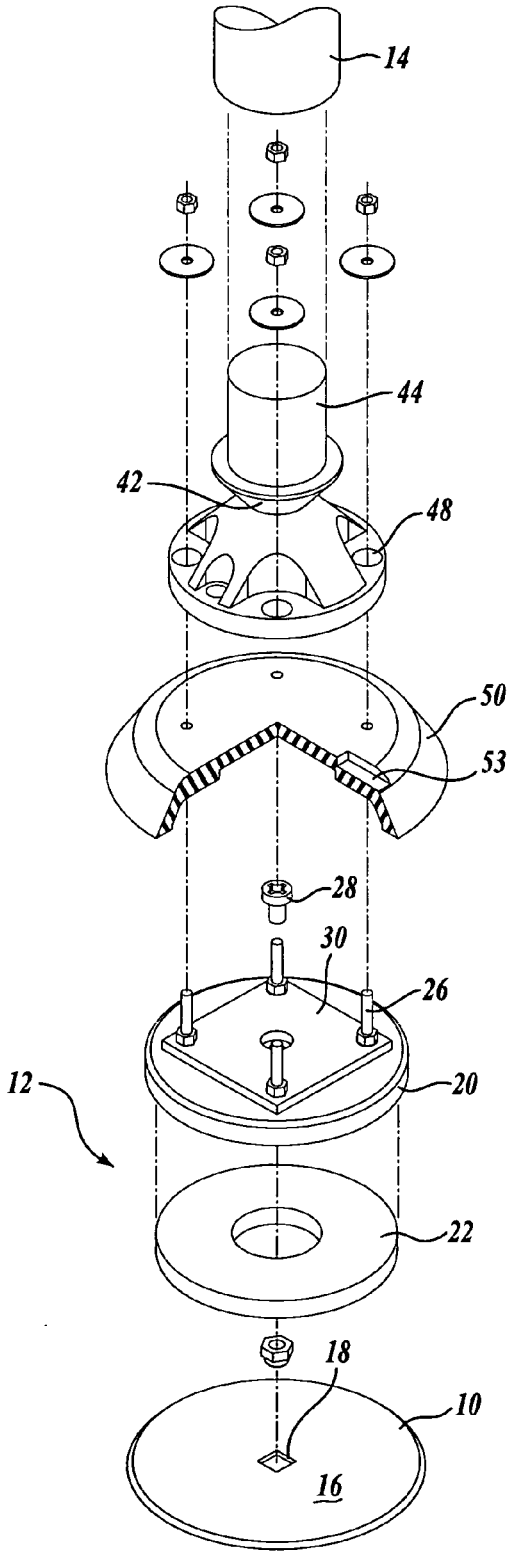
FIG. 2A is an exploded detail view with a partial cutaway section of one embodiment of an assembly formed in accordance with the present invention.
Figure 2B:
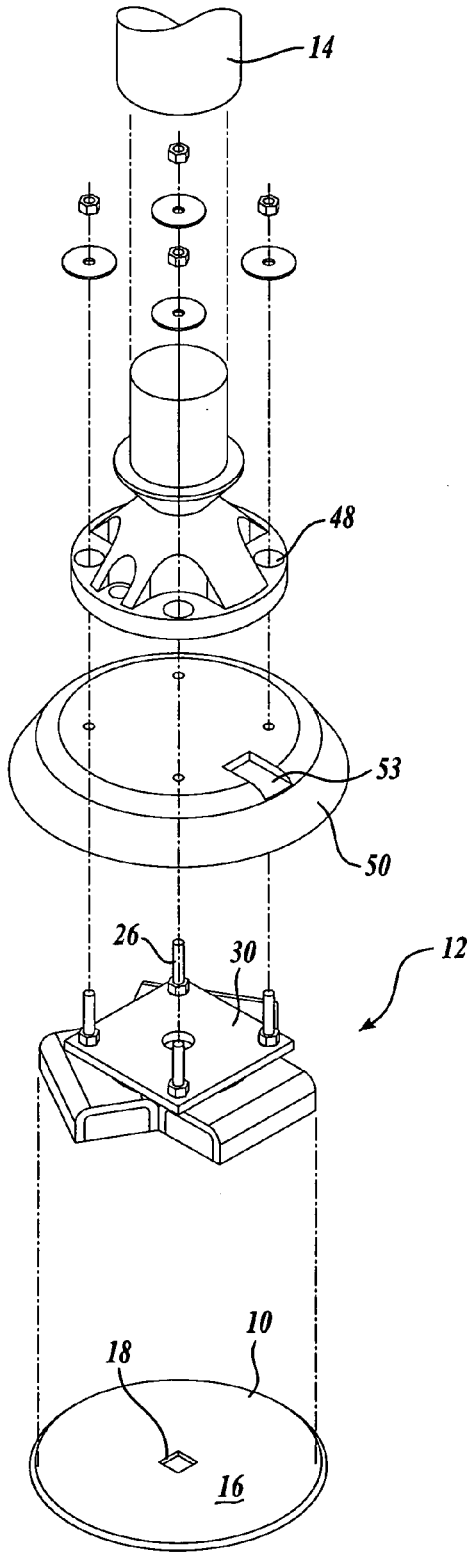
FIG. 2B is an exploded detail view of another embodiment of an assembly formed in accordance with the present invention.

Referring to FIGS. 2A and 2B, the assembly includes a base plate 10 and a magnet assembly 12. A post or other object is connectable to the magnet assembly, preferably in a manner that one is separable from the other. In these embodiments, the base plate is a circular steel disc having a beveled outer periphery. It is approximately 5 inches in diameter and 3/16-inch in thickness. The base plate is permanently adhered to (or formed into) a sidewalk or other hard smooth surface. The upper surface 16 of the base plate 10 is preferably made of a nonskid material. This is particularly useful if there is a need to meet safety standards for public use. The base plate 10 includes an opening 18 at its center. In one embodiment, the opening is a ½-inch by ½-inch square.

Figure 3:
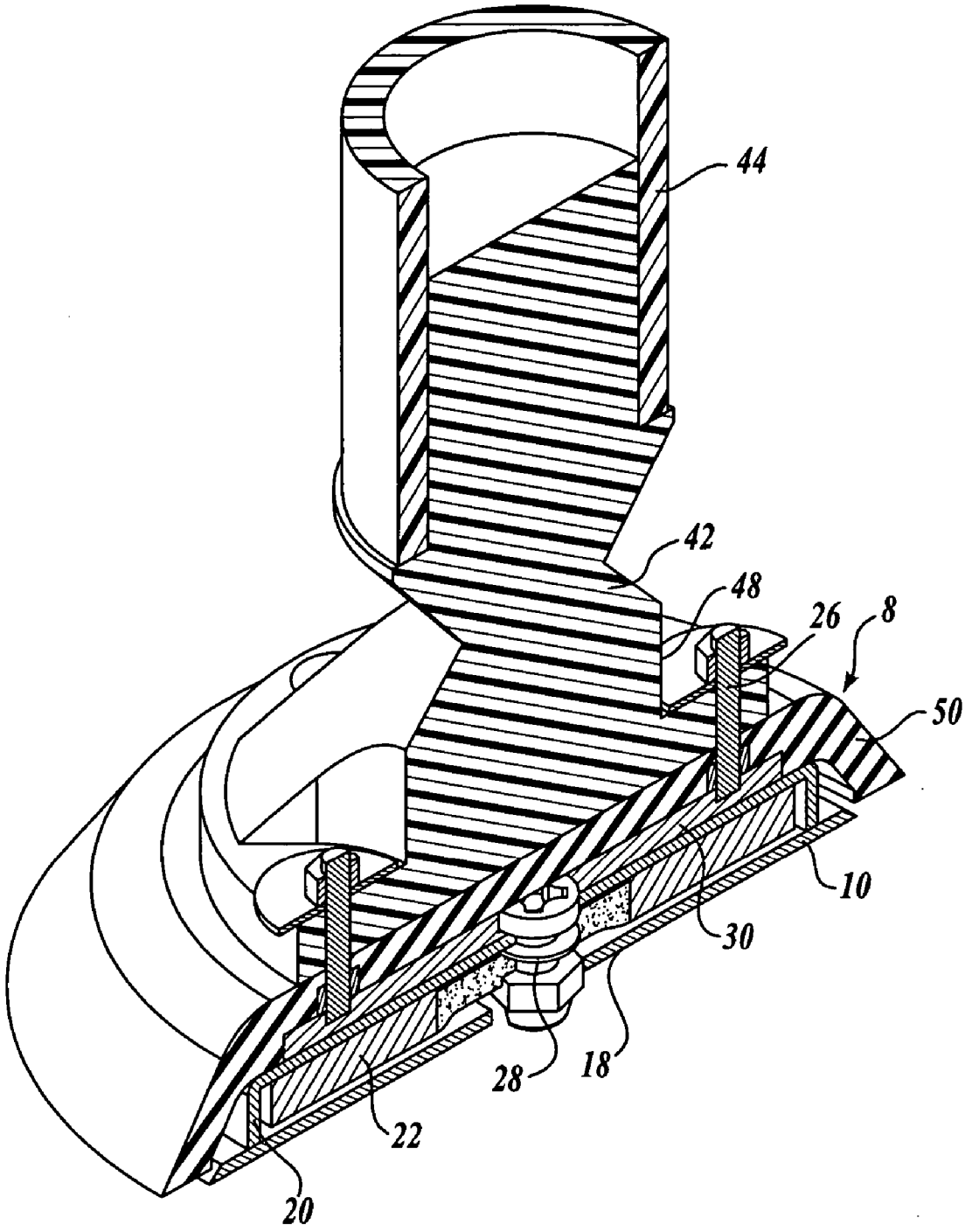
FIG. 3 is a cross-sectional side view of the embodiment of FIG. 2A.
Figure 4:
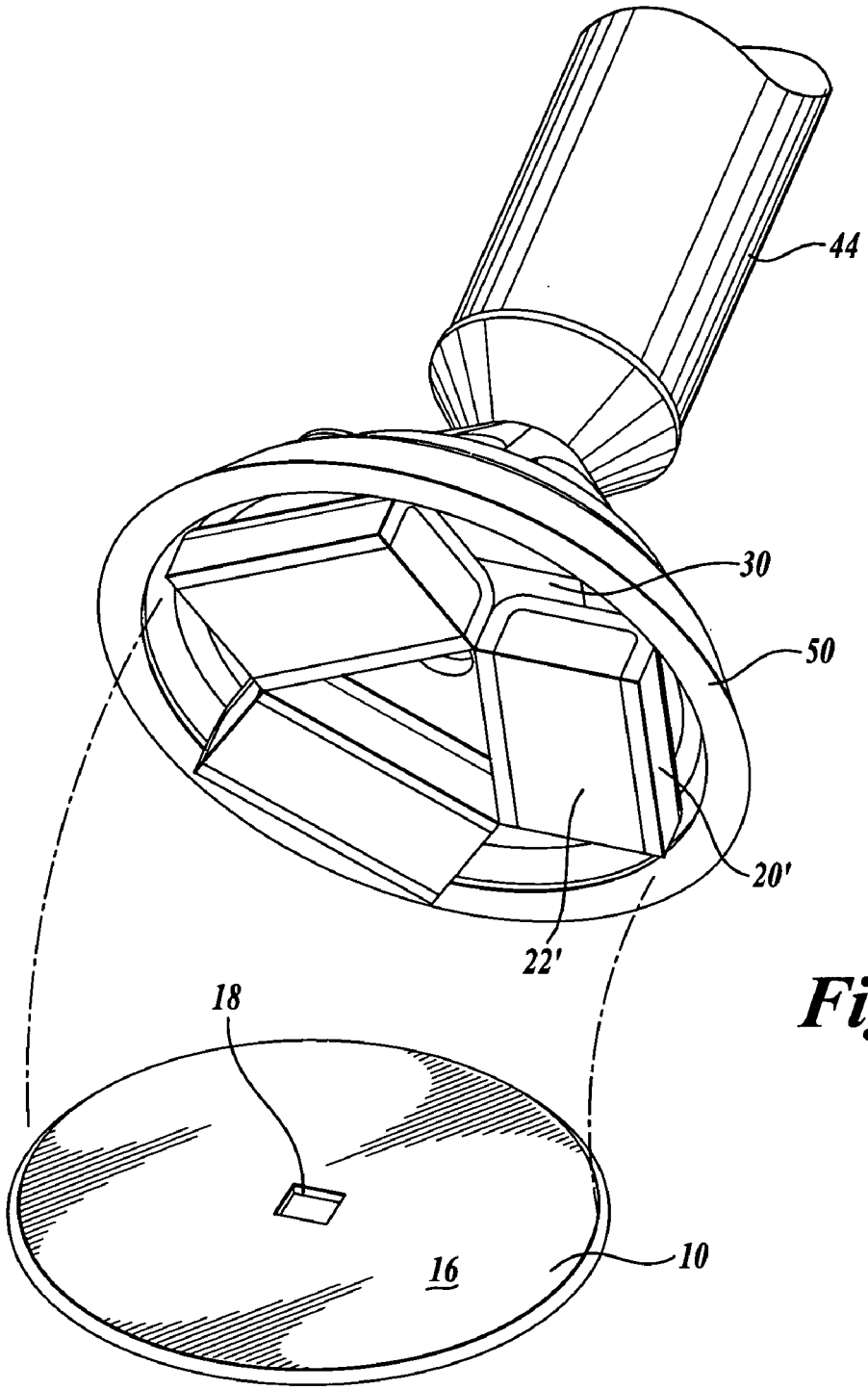
FIG. 4 is a perspective view further illustrating the embodiment of FIG. 2B.

In the arrangements of FIGS. 2A and 3, the magnet assembly 12 includes a cup-shaped metal housing 20 and a ring magnet 22. The ring magnet 22 is adhered onto the upper inside surface of the housing. The lower portion of the housing is open. In this way, the housing has a shallow upside-down bowl shape. The upper surface of the housing includes a number of upwardly extending attachment bolts 26. A central bolt 28 extends downwardly from the middle of the housing. In the embodiment shown, the attachment bolts 26 and the central bolt 28 are formed on opposite sides of an attachment plate 30. An opening in the center of the housing allows the central bolt to extend downward therethrough. As will be appreciated from those skilled in the art, other configurations are possible.

In FIG. 2B, the magnet assembly 12 includes separate U-shaped housings 20' that each contain their own magnet 22'. The housings 20' face downward, end-to-end, in a circular arrangement. An attachment plate 30 is connected to the upper surfaces of the housings. One of the advantages of the arrangement of FIG. 2B is that it provides a magnetic arrangement that is difficult to accidentally remove from the base plate. Because the magnets are provided in opposing orientations, shearing forces are minimized. This further allows the use of particularly strong magnets, such as rare-earth magnets (e.g., neodymium magnets).

In either arrangement, the housing is preferably made of a material that can carry a magnetic current, e.g., steel. This allows the housing to attract and attach to the base plate during use, as opposed to the magnet or magnets attaching directly to the base plate. In general, such arrangement is referred to as a "cup magnet" arrangement, since it is the "cup" itself that is physically connected to a magnetic surface.

In some embodiments, the strength of the magnets will be significant. If such magnets are attached directly to the base plate, the task of manually separating these parts may become too difficult for the average user. In FIG. 2A, the notch 34 is available in the assembly housing to allow a user to pry the magnet assembly from the base plate. The ring magnet is preferably formed of a rare-earth or ceramic material.

As mentioned above, the attachment assembly of the present invention is particularly useful for separably connecting a post 14 to a fixed base. In FIG. 1, a sign 40 is shown releasably connected to a sidewalk. In this arrangement, the preferred post is a conventional impact-recovery post. The impact-recovery post includes a spring-loaded base 42 and an upright pole 44. The base 42 includes a number of boltholes 48 positioned to align with the magnet assembly's attachment bolts.

To assemble the sign of FIG. 1, the base 42 is bolted onto the attachment bolts 26, with an optional rubber shroud 50 positioned therebetween. The combination is then lowered onto the base plate 10 that is adhered to the sidewalk, or other essentially smooth solid surface. In this embodiment, the magnet 22 does not directly touch the base plate 10. Magnetic forces between the lower edges of the housing 20 and the base plate 10 are sufficient to maintain the magnet assembly on the base plate. An opening 53 in the shroud is available for use in peeling the magnet assembly from the base plate. See FIG. 2A. A lever-type prying device is inserted into the opening 54 and rotatable about a fulcrum contacting the adjacent ground. The user pries the magnet assembly away from the base plate.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A magnetic assembly for reversibly securing an object to a base plate capable of carrying a magnetic current and secured on a surface, the magnetic assembly comprising:

(a) a housing formed of a material capable of carrying a magnetic current, wherein the housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside such that the bottom surface of the magnet is disposed in the open underside so as to be spaced above the plane of the lower peripheral edge a predetermined distance;

(c) a fastening assembly adapted to couple an object to the housing; and (d) means for limiting lateral movement of the magnet assembly relative to the surface.

2. The magnetic assembly according to claim 1, wherein the housing includes a lateral upper wall.

3. A magnetic assembly for reversibly securing an object to a base plate capable of carrying a magnetic current and secured on a surface, the magnetic assembly comprising:

(a) a housing formed of a material capable of carrying a magnetic current, wherein the housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside such that the bottom surface of the magnet is disposed in the open underside so as to be spaced above the plane of the lower peripheral edge a predetermined distance;

(c) a fastening assembly adapted to couple an object to the housing; and (d) an attachment plate, the attachment plate located adjacent the lateral upper wall of the housing.

4. The magnetic assembly according to claim 3, wherein the attachment plate includes at least one attachment fastener extending from the attachment plate, the at least one attachment fastener adapted to engage the object.

5. The magnetic assembly according to claim 4, wherein the attachment plate is welded to an outer surface of the lateral upper wall of the housing.

6. The magnetic assembly according to claim 4, further comprising a shroud adjacent the attachment plate.

7. The magnetic assembly according to claim 6, wherein the shroud includes at least one hole adapted to receive the at least one attachment fastener extending from the attachment plate.

8. A magnetic assembly for reversibly securing an object to a base plate capable of carrying a magnetic current and secured on a surface, the magnetic assembly comprising:

(a) a housing formed of a material capable of carrying a magnetic current, wherein the housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside such that the bottom surface of the magnet is disposed in the open underside so as to be spaced above the plane of the lower peripheral edge a predetermined distance, wherein the magnet is a ring magnet and the housing has a circular cup shape, wherein as assembled, a center axis of the ring magnet is located substantially coaxially with a center axis of the housing; and (c) a fastening assembly adapted to couple an object to the housing.

9. A magnetic assembly for reversibly securing an object to a base plate capable of carrying a magnetic current and secured on a surface, the magnetic assembly comprising:

(a) a housing formed of a material capable of carrying a magnetic current, wherein the housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside such that the bottom surface of the magnet is disposed in the open underside so as to be spaced above the plane of the lower peripheral edge a predetermined distance, wherein the magnet is a bar magnet and the housing has a rectangular channel shape, wherein as assembled, the bar magnet is located colinearly in the housing; and (c) a fastening assembly adapted to couple an object to the housing.

10. A magnetic assembly for reversibly securing an object to a base plate capable of carrying a magnetic current and secured on a surface, the magnetic assembly comprising:

(a) a housing formed of a material capable of carrying a magnetic current, wherein thc housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside such that the bottom surface of the magnet is disposed in the open underside so as to be spaced above the plane of the lower peripheral edge a predetermined distance, wherein the magnet assembly includes at least three bar magnets positioned within separate rectangular housings; and (c) a fastening assembly adapted to couple an object to the housing.

11. The magnetic assembly according to claim 10, wherein the separate rectangular housings are arranged in differing orientations to follow a generally circular path.

12. The magnetic assembly according to claim 1, wherein the magnet is adhered to the inside of the housing.

13. The assembly according to claim 1, wherein the housing is made of a material including at least steel.

14. A magnetic assembly for reversibly securing an object to a base plate capable of carrying a magnetic current and secured on a surface, the magnetic assembly comprising:

(a) a housing formed of a material capable of carrying a magnetic current, wherein the housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside such that the bottom surface of the magnet is disposed in the open underside so as to be spaced above the plane of the lower peripheral edge a predetermined distance; and (c) a fastener extending outward from a point located inside of the housing a predetermined distance such that a distal end of the fastener is disposed outside of the open underside, past a bottom surface of the open underside, and past the bottom surface of the magnet.

15. A magnetic assembly for reversibly securing an object to a base plate capable of carrying a magnetic current and secured on a surface, the magnetic assembly comprising:

(a) a housing formed of a material capable of carrying a magnetic current, wherein the housing has an open underside having a depth and a lower peripheral edge, wherein the lower peripheral edge defines a plane;

(b) a magnet disposed within the open underside, wherein the magnet has a top surface, a bottom surface, and a thickness between the top surface and the bottom surface, the thickness being lesser in dimension than the depth of the open underside of the housing such that the bottom surface of the magnet is disposed in the open underside of the housing so as to be spaced above the plane of the lower peripheral edge a predetermined distance;

(c) a fastening assembly coupled to the housing for permitting the object to be coupled to the housing; and (d) a shroud at least partially covering an outer surface of the housing, the shroud having an opening for permitting a prying device to be at least partially inserted into the opening for prying the magnetic assembly from the base plate when connected to the base plate.

16. The magnetic assembly of claim 15, wherein the shroud is made from a material not capable of carrying a magnetic current.

17. A magnetic assembly for reversibly securing an object to a base plate capable of carrying a magnetic current and secured on a surface, the magnetic assembly comprising:

(a) a shroud defining a cavity having an open underside and a lower peripheral edge, wherein the lower peripheral edge defines a plane;

(b) a magnet disposed in the cavity, the magnet adapted to magnetically secure the magnetic assembly to the base plate, wherein the magnet has a top surface, a bottom surface, and a thickness between the top surface and the bottom surface, the thickness being lesser in dimension than the depth of the cavity such that the bottom surface of the magnet is disposed in the cavity so as to be spaced above the plane of the lower peripheral edge a predetermined distance;

(c) a fastening assembly adapted to couple the object to the shroud; and (d) a fastener at least partially disposed in the shroud, the fastener extending from a location disposed in the cavity to a location disposed outside of the cavity such that a distal end of the fastener is located past the plane of the lower peripheral edge to be received within an opening in the base plate when the magnetic assembly is magnetically coupled to the base plate for limiting lateral movement of the magnet assembly relative to the base plate.

18. A magnetic assembly for reversibly securing an object to a base plate capable of carrying a magnetic current and secured on a surface, the magnetic assembly comprising:

(a) a shroud defining a cavity having an open underside and a lower peripheral edge, wherein the lower peripheral edge defines a plane;

(b) a magnet disposed in the cavity so as not to extend past the plane, the magnet adapted to magnetically secure the magnetic assembly to the base plate, wherein the magnet includes three or more magnets each having a length, wherein the three or more magnets are each disposed within the shroud such that the length of each of the three or more magnets are angled at oblique angles relative to one another such that the three or more magnets form a generally circular pattern disposed about the fastener;

(c) a fastening assembly adapted to couple the object to the shroud; and (d) a fastener at least partially disposed in the shroud, the fastener extending from a location disposed in the cavity to a location disposed outside of the cavity such that a distal end of the fastener is located past the plane to be received within an opening in the base plate when the magnetic assembly is magnetically coupled to the base plate for limiting lateral movement of the magnet assembly relative to the base plate.

19. A magnetic assembly for reversibly securing an object to a base plate capable of carrying a magnetic current and secured on a surface, the magnetic assembly comprising:

(a) a shroud defining a cavity having an open underside and a lower peripheral edge, wherein the lower peripheral edge defines a plane;

(b) a magnet disposed in the cavity so as not to extend past the plane, the magnet adapted to magnetically secure the magnetic assembly to the base plate, wherein the magnet includes a ring shaped magnet, wherein the fastener passes through a center of the ring shaped magnet;

(c) a fastening assembly adapted to couple the object to the shroud; and (d) a fastener at least partially disposed in the shroud, the fastener extending from a location disposed in the cavity to a location disposed outside of the cavity such that a distal end of the fastener is located past the plane to be received within an opening in the base plate when the magnetic assembly is magnetically coupled to the base plate for limiting lateral movement of the magnet assembly relative to the base plate.

20. The magnetic assembly of claim 17, wherein the shroud is not made from a material capable of carrying a magnetic current.

* * * * *